US006009288A

United States Patent [19]

Akutsu

[11] Patent Number: 6,009,288

[45] Date of Patent: Dec. 28, 1999

[54] ELECTROPHOTOGRAPHIC IMAGE FORMING APPARATUS AND PROCESS CARTRIDGE DETACHABLY MOUNTABLE THEREON HAVING FIRST AND SECOND CARTRIDGE CONTACT PORTIONS

[75] Inventor: Takashi Akutsu, Toride, Japan

[73] Assignee: Canon Kabushiki Kaisha, Tokyo, Japan

[21] Appl. No.: 09/190,115

[22] Filed: Nov. 12, 1998

[30] Foreign Application Priority Data

Nov. 14, 1997 [JP] Japan ..... 9-331274
Nov. 6, 1998 [JP] Japan ..... 10-332069

[51] Int. Cl.[6] ..... G03G 21/16

[52] U.S. Cl. ..... 399/111; 399/113

[58] Field of Search ..... 399/111, 112, 399/113, 114, 116, 119, 120, 125, 13

[56] References Cited

U.S. PATENT DOCUMENTS 4,809,033 2/1989 Ikemoto et al. ..... 399/111
5,245,394 9/1993 Ikeda et al. ..... 399/13
5,319,418 6/1994 Fujimoto et al. ..... 399/167
5,493,366 2/1996 Satoh et al. ..... 399/111
5,893,006 4/1999 Kanno et al. ..... 399/13

*Primary Examiner*—Matthew S. Smith
*Assistant Examiner*—Hoan Tran
*Attorney, Agent, or Firm*—Fitzpatrick, Cella, Harper & Scinto

[57] ABSTRACT

A process cartridge, adapted for use in a main body of an electrophotographic image forming apparatus provided with a guide member to guide the recording medium in the conveying direction thereof and which can assume either a guide position or a retracted position, includes a cartridge frame, an electrophotographic photosensitive member, a process device for acting on the electrophotographic photosensitive member, and a cartridge contact portion to impinge on a main body contact portion provided on the guide member if the guide member is in the retracted position in mounting the process cartridge in the main body of the apparatus to shift the guide member to the guide position. The cartridge contact portion is provided on the cartridge frame.

23 Claims, 9 Drawing Sheets

ELECTROPHOTOGRAPHIC IMAGE FORMING APPARATUS AND PROCESS CARTRIDGE DETACHABLY MOUNTABLE THEREON HAVING FIRST AND SECOND CARTRIDGE CONTACT PORTIONS

BACKGROUND OF THE INVENTION

1. Field of the Invention

The present invention relates to an electrophotographic image forming apparatus such as a laser beam printer or a copying apparatus, and a process cartridge for use in such electrophotographic image forming apparatus.

2. Related Background Art

The electrophotographic image forming apparatus based on the electrophotographic image forming process executes selective exposure according to image information on an electrophotographic photosensitive member uniformly charged with charging means to form a latent image. Then it develops the latent image with toner in developing means to form a toner image, and transfers the toner image formed on the electrophotographic photosensitive member onto a recording sheet by transfer means to execute image formation.

For facilitating maintenance in such electrophotographic image forming apparatus, it is widely practiced to integrate the charging means, developing means or cleaning means with the electrophotographic photosensitive member as a process cartridge which is detachably mounted in the main body of the image forming apparatus.

In such image forming apparatus, image formation is achieved by conveying the recording sheet by paired rollers. For example, the recording sheet is pinched and conveyed by a convey roller driven by a motor through gears and an idler roller rotated in pressure contact with such convey roller, and the image is formed on such recording sheet by image forming means. A guide member is provided in the conveying direction of the above-mentioned paired rollers, in order to achieve exact conveyance of the recording sheet. In such recording sheet conveying means, there has been already known a guide member that can be retracted in case of sheet jamming, in order to facilitate removal of the jammed recording sheet.

The present invention is designed to further extend the prior technology.

SUMMARY OF THE INVENTION

An object of the present invention is to provide a process cartridge and an electrophotographic image forming apparatus, capable of improving the operability in mounting or detaching (removing) the process cartridge on or from the main body of the image forming apparatus.

Another object of the present invention is to provide a process cartridge detachably mountable on an electrophotographic image forming apparatus provided with a convey guide retractable from a predetermined position, and an electrophotographic image forming apparatus adapted for use with such a process cartridge.

Still another object of the present invention is to provide a process cartridge and an electrophotographic image forming apparatus which are capable, even when the process cartridge is mounted without returning the guide member to the original position, of preventing the guide member from impinging on the electrophotographic photosensitive drum, thereby preventing the electrophotographic photosensitive drum from being damaged.

Still another object of the present invention is to provide a process cartridge provided with a cartridge contact portion for impinging on a main body contact portion on a guide member, if the guide member provided in the main body of the apparatus is in the aforementioned retracted position, in mounting the process cartridge on the main body of the apparatus, to shift the guide member to the guide position, and an electrophotographic image forming apparatus adapted for use with such a process cartridge.

DETAILED DESCRIPTION OF THE PREFERRED EMBODIMENTS

Embodiment 1

In the following there will be explained, with reference to FIGS. 1 to 9, a process cartridge of a first embodiment and an electrophotographic image forming apparatus capable of mounting such process cartridge thereon. At first reference is made to FIGS. 3 to 5 for explaining the entire configuration of the process cartridge and the image forming apparatus capable of mounting the same, then to FIGS. 2, 6A and 6B for explaining an upper transfer guide, and finally to FIGS. 1, 6A, 6B and 9 for explaining the relationship between the shape of a frame member of the process cartridge and the upper transfer guide.

Entire Configuration

Figure 3:
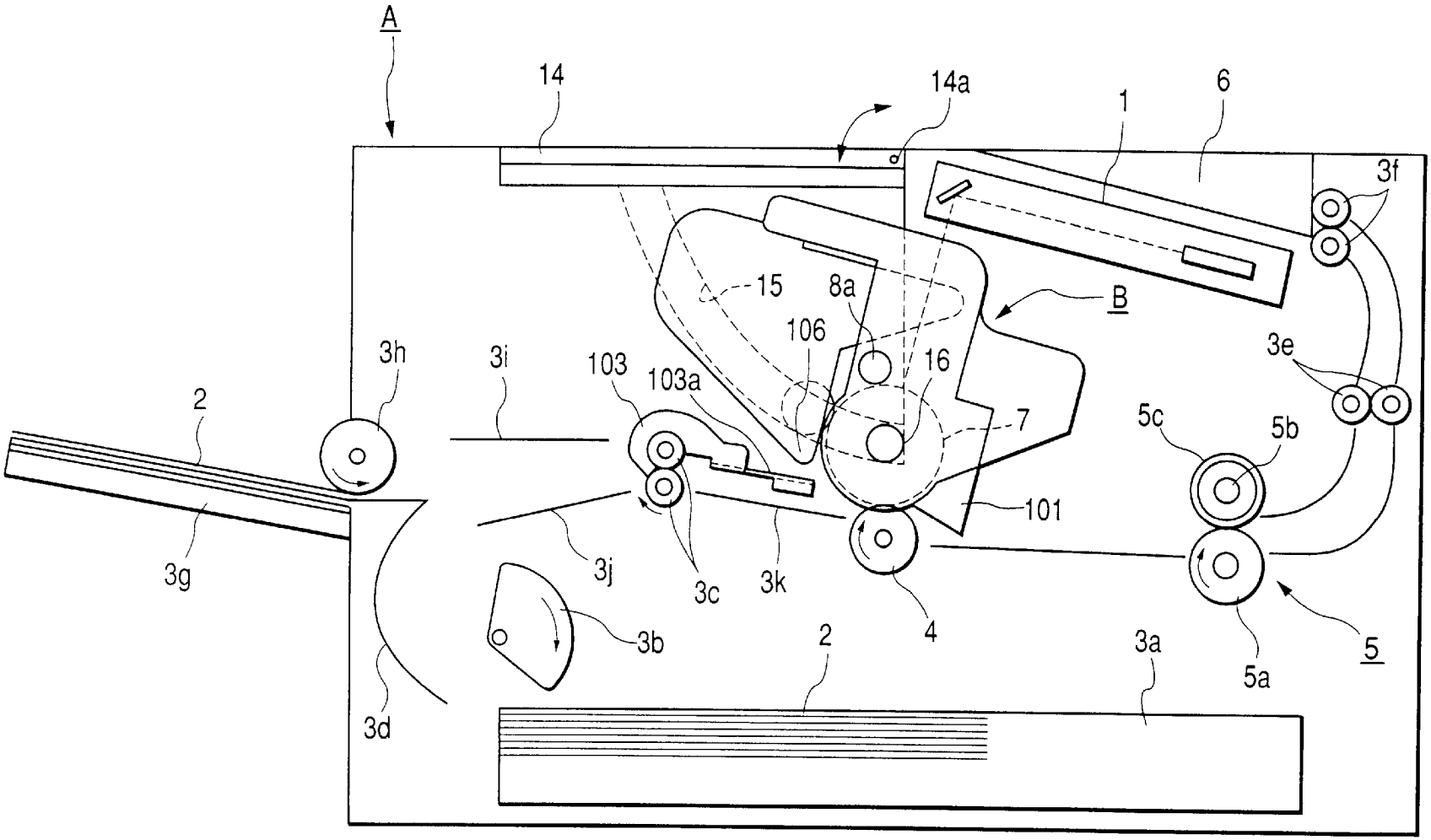
FIG. 3 is a longitudinal cross-sectional view showing the entire configuration of the image forming apparatus constituting an embodiment of the present invention.

In the electrophotographic image forming apparatus (laser beam printer) A, as shown in FIG. 3, a laser beam emitted from an optical system 1 and modulated according to the image information irradiates a drum-shaped electrophotographic photosensitive member (photosensitive drum) 7 to form a latent image thereon, which is then developed into a toner image. In synchronization with the formation of the toner image, a recording sheet (recording medium) is picked up from a sheet cassette 3*a* by a pickup roller 3*b* and is conveyed, by conveying means composed of paired convey rollers 3*c*, an upper transfer guide 103 etc., to a nip portion between the photosensitive drum 7 and a transfer roller (transfer means) 4. By the application of a voltage to the transfer roller 4, the toner image formed on the photosensitive drum 7 is transferred onto the recording sheet 2, which is then conveyed to fixing means 5. The fixing means 5 is composed of a driving roller 5*a* and a fixing roller 5*c* incorporating a heater 5*b*, and applies heat and pressure to the passing recording sheet 2 thereby fixing the transferred toner image. Subsequently the recording sheet 2 is conveyed by paired discharge rollers 3*e*, 3*f* and is discharged to a discharge unit 6 through an inverting path. The image forming apparatus A also allows manual sheet feeding by a manual insertion tray 3*g* and a roller 3*h*.

On the other hand, a process cartridge B is provided with an electrophotographic photosensitive member and at least a process means. Examples of such process means includes charging means for charging the electrophotographic photosensitive member, developing means for developing the latent image formed on the electrophotographic photosensitive member, and cleaning means for removing the toner remaining on the electrophotographic photosensitive member.

Figure 4:
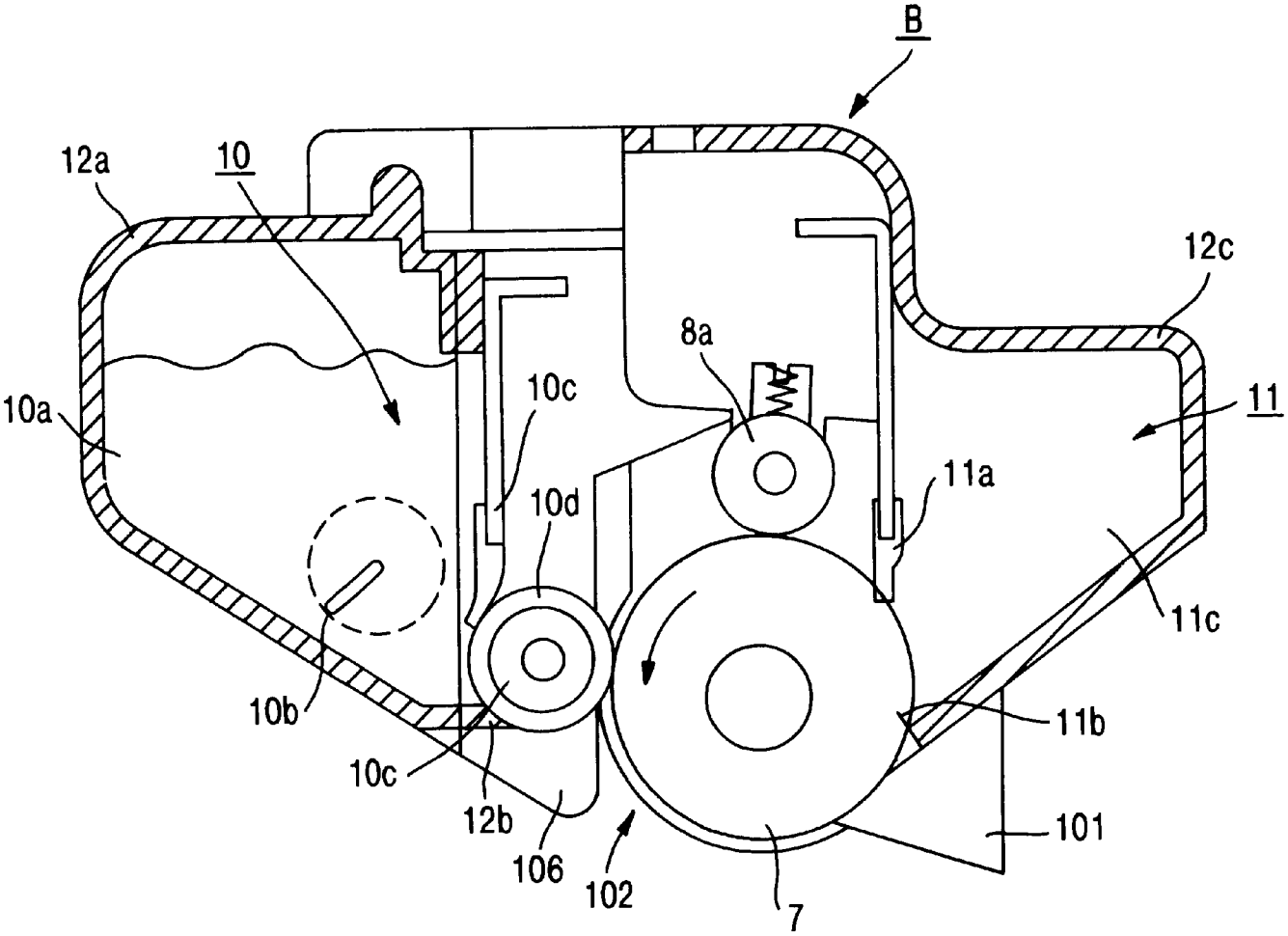
FIG. 4 is a longitudinal cross-sectional view showing the entire configuration of the process cartridge constituting an embodiment of the present invention.

As shown in FIG. 4, the process cartridge of the present embodiment is for rotating the drum-shaped electrophotographic photosensitive member (hereinafter called "photosensitive drum") 7, uniformly charging the surface thereof by voltage application to the charging roller 8*a* (charging means 8), exposing the photosensitive drum 7 to the information-bearing light beam from the optical system 1, thereby forming a latent image, and developing the latent image by developing means 10. The developing means 10 is for feeding the toner in a toner container 10*a* by a toner feeding member 10*b*, rotating a developing roller 10*d* incorporating a fixed magnet 10*c*, forming a toner layer having a triboelectric charge caused by a developing blade 10*e* on the surface of the developing roller 10*d*, and transferring the toner to the photosensitive drum 7 according to the latent image thereby forming a visible toner image. After the toner image is transferred onto the recording sheet 2 by the application to the transfer roller 4 of a voltage of a polarity opposite to that of the toner image, the toner remaining on the photosensitive drum 7 is eliminated by the cleaning means 11 which scrapes off the remaining toner with a cleaning blade 11*a*, scoops it up with a scooping sheet 11*b*, and collects it in a used toner container 11*c*.

A developing unit is formed by fusing the toner container 12*a* with a developing frame 12*b* supporting developing members such as the developing roller 10*d*, and is housed in a cartridge frame constructed by combining a cleaning frame 12*c* with a cleaning unit supporting the photosensitive drum 7, the cleaning means 11 etc. Thus, the above-mentioned components, such as the photosensitive drum 7, are formed as a cartridge, which is detachably mounted on cartridge mounting means provided in a main body 13 of the apparatus.

Figure 5:
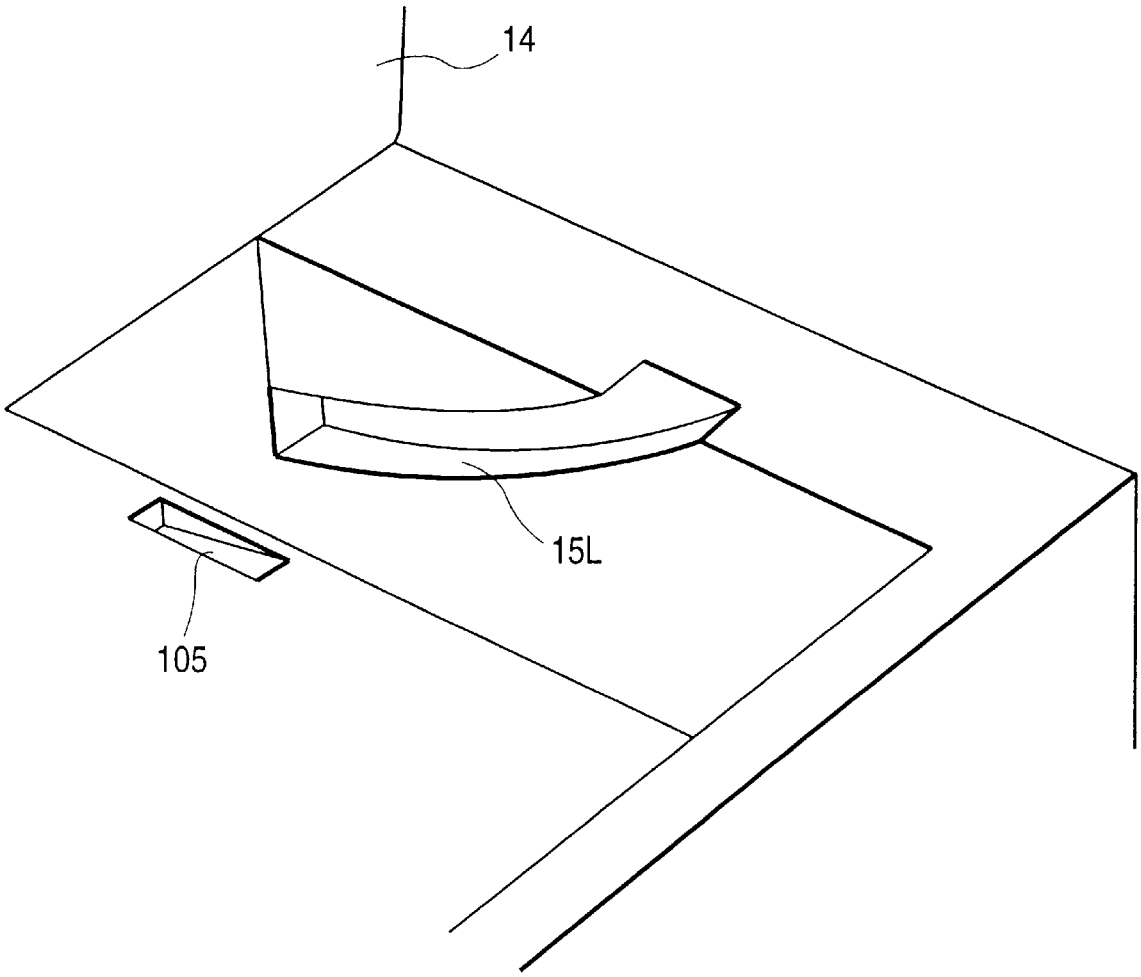
FIG. 5 is a perspective view showing a mounting portion of the process cartridge constituting an embodiment of the present invention.

When a cover 14 is opened by rotation about an axis 14*a* shown in FIG. 3, there appears, as shown in FIG. 5, cartridge mounting means consisting of cartridge mounting guides 15 (15L, 15R) formed as arc-shaped grooves on both lateral faces of a cartridge mounting space (FIG. 5 showing one lateral face only) and constituting guides for inserting the process cartridge B. The cartridge B can be mounted on the image forming apparatus A by fitting pins 16 and positioning members (not shown) protruding on both ends in the longitudinal direction of the cartridge frame, positioning the pins 16 at the end of the guides 15 and closing the cover 14.

The conveying path for the recording sheet 2, from the sheet cassette 3*a* to the nip between the photosensitive drum 7 and the transfer roller 4 is composed of an inverting guide 3*d* for inverting the recording sheet 2 fed from the sheet cassette 3*a* by the pickup roller 3*b*, a conveying path formed by a fixed upper guide 3*i* and a fixed lower guide 3*j* positioned respectively corresponding to the manual insertion roller 3*h* and the inverting guide 3*d*, paired convey rollers 3*c* provided at the exit side of the conveying path, a movable upper transfer guide 103 for guiding the recording sheet 2 from the paired convey rollers 3*c* to the nip between the photosensitive drum 7 and the transfer roller 4, and a fixed lower transfer guide 3*k*.

Upper Transfer Guide

Figure 2:
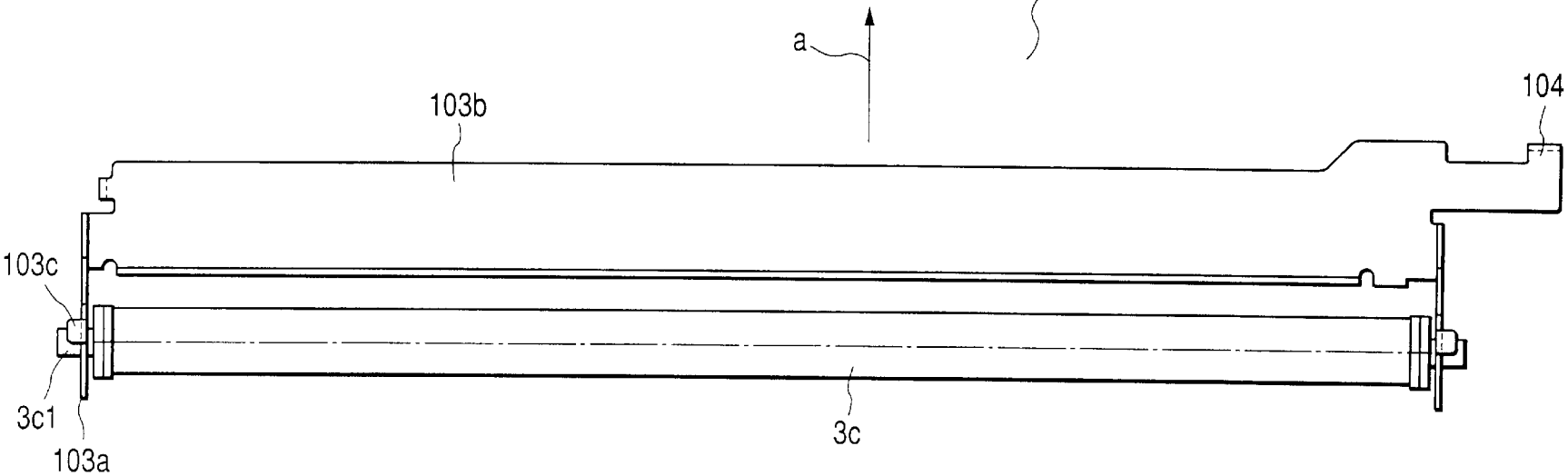
FIG. 2 is a plan view showing an upper transfer guide of the image forming apparatus constituting an embodiment of the present invention.
Figure 6A:
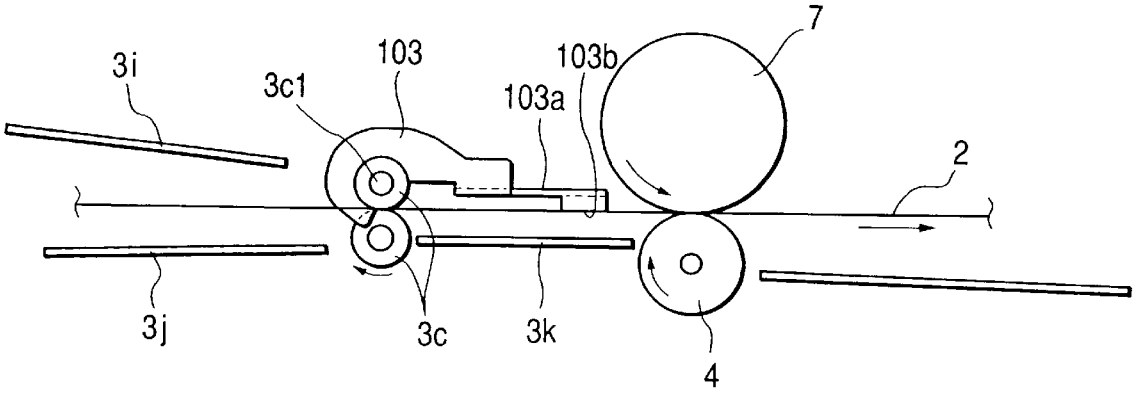
FIGS. 6A and 6B are lateral views showing the upper transfer guide of the image forming apparatus constituting an embodiment of the present invention.
Figure 6B:
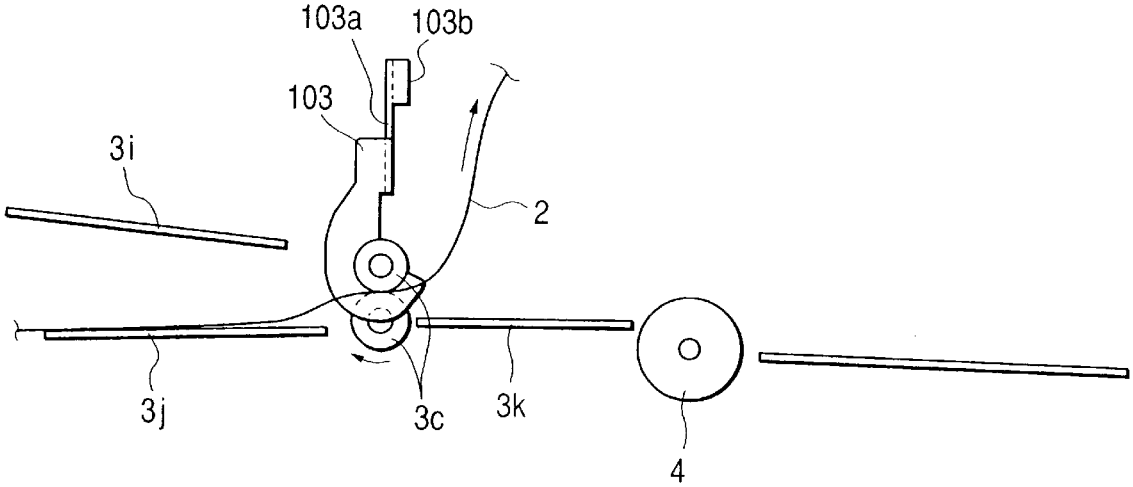
Figure 7:
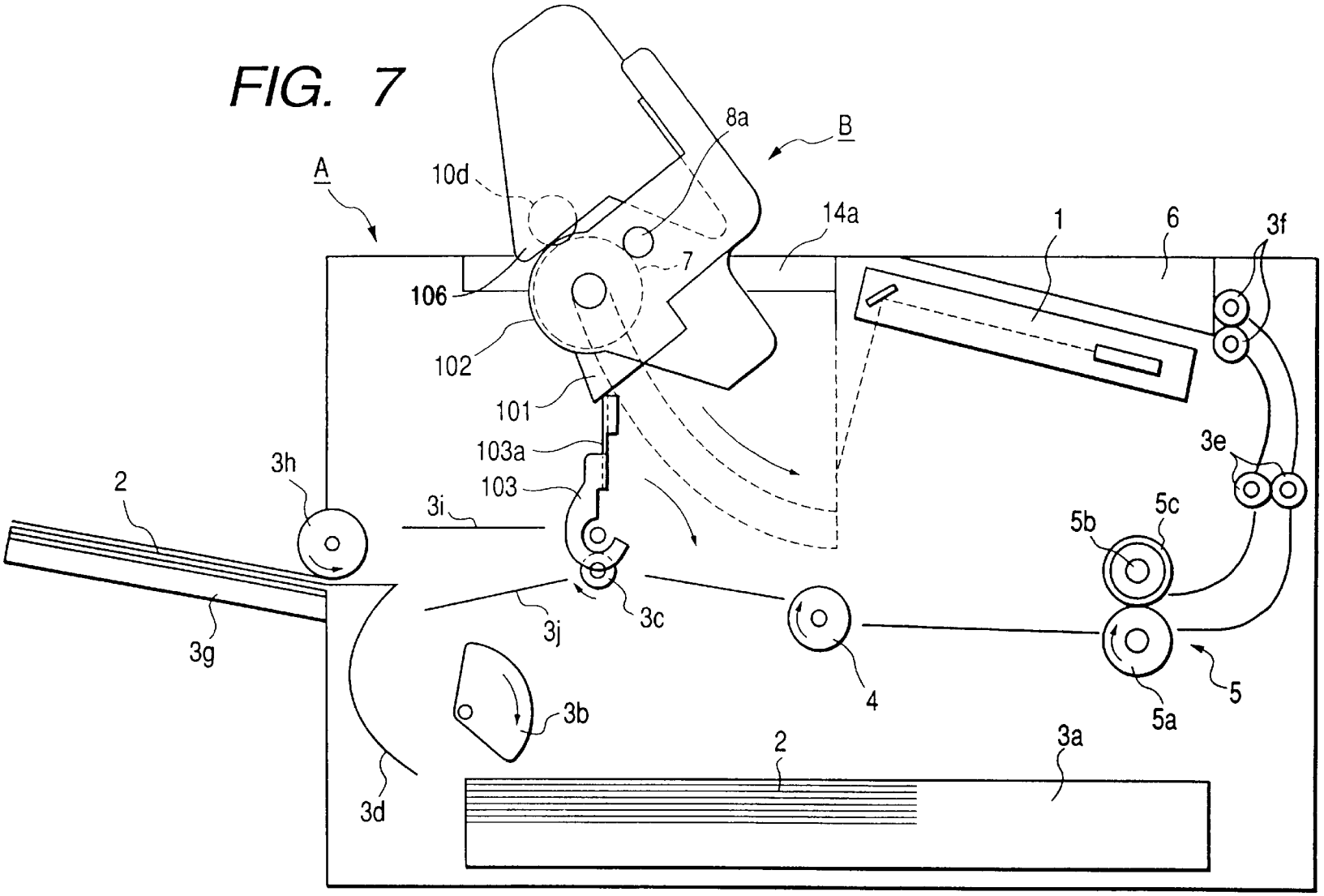
FIG. 7 is a lateral view showing the function of a projection provided in the frame of the process cartridge constituting an embodiment of the present invention.

As shown in FIGS. 6A and 6B, the upper transfer guide 103 is rotatably mounted on the shaft 3*c*1 of the upper roller of the paired convey rollers 3*c*. In the case of sheet jamming under the upper transfer guide 103, the operator detaches the process cartridge B. It is thus rendered possible to easily remove the jammed recording sheet 2 by manually lifting upwards the upper transfer guide 103. Referring to FIG. 2, the convey roller 3*c* is made longer than the width of the recording sheet 2 perpendicular to the conveying direction (a) thereof, and on each of the shafts 3*c*1 protruding on both ends of the roller there are articulated a base portion of an arm 103*a* of the upper transfer guide 103 integral with a guide portion 103*b*, and a bent 103*c* radially distant from the articulated portion impinges on a stopper (not shown), whereby the upper transfer guide 103 is maintained in a lying position shown in FIG. 3.

Figure 1:
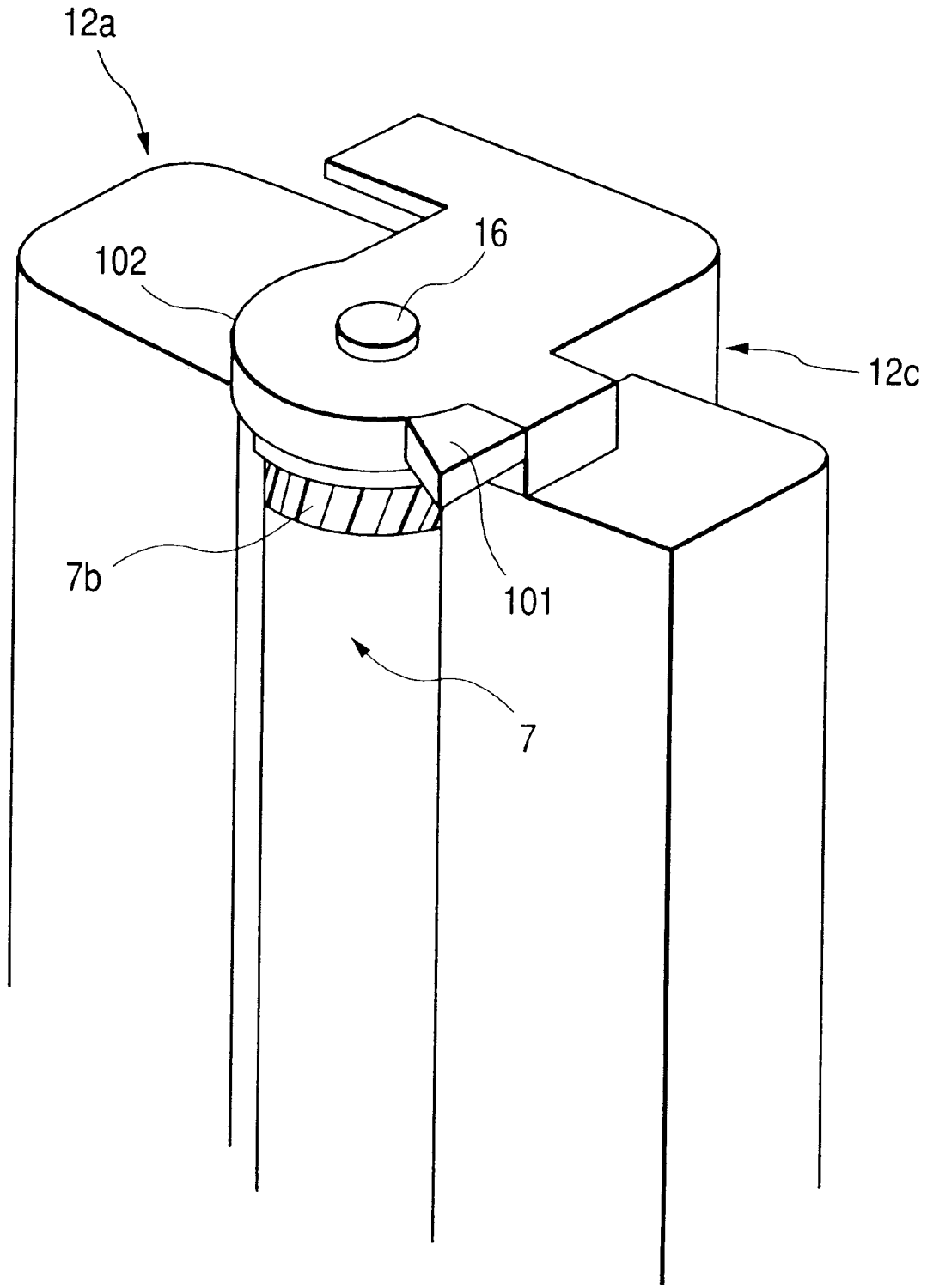
FIG. 1 is a perspective view showing the shape of a frame of a process cartridge constituting an embodiment of the present invention.

Also as shown in FIG. 2, the upper transfer guide 103 is provided with a receiving portion 104 (main body contact portion), which is in such a position as to impinge on a projection 101 (cartridge contact portion) or an arc-shaped portion 102 (cartridge contact portion) provided in the frame of the process cartridge B as shown in FIG. 1 when the upper transfer guide 103 is in the standing position or when the process cartridge is removed while the upper transfer guide 103 is lifted by a jammed recording sheet 2. As will be explained later, the receiving portion 104 is used for turning down the upper transfer guide 103 in the standing position or pressing down the upper transfer guide 103 pushed up by the jammed recording sheet 2.

The projection 101 and the arc-shaped portion 102 mentioned above are formed integrally with the cleaning frame 12*c* or separately formed and fixed thereto. In the present embodiment, the projection 101 and the arc-shaped portion 102 are integrally formed with the cleaning frame 13*c*.

Shape of Cartridge Frame and Relationship to Upper Transfer Guide

The frame of the process cartridge B is shaped as shown in FIG. 1.

The shape of the frame is at first featured by the presence of the projection 101 in a position in front of the photosensitive drum 7 in the inserting direction of the process cartridge B, and outside the conveying area of the recording sheet in the longitudinal direction (axial direction of the photosensitive drum 7).

In the image forming apparatus A of the present embodiment, in the case of sheet jamming under the upper transfer guide 103, the operator at first detaches the process cartridge. Then the operator lifts the upper transfer guide 103 and removes the jammed sheet. In mounting the detached process cartridge again after the jammed sheet disposal operation, the operator may forget to return the standing upper transfer guide 103 to the original position and may insert the process cartridge B while the upper transfer guide 103 is still in the standing position.

However, even in such a case, it is to be noted that the projection 101 (cartridge contact portion) is provided in a position in front of the photosensitive drum 7 in the inserting direction of the process cartridge, and outside the conveying area of the recording sheet in the longitudinal direction of the photosensitive drum 7. Also the receiving portion 104 (main body contact portion) of the upper transfer guide 103 is provided in a position impinging on the projection 101.

Therefore, in the course of mounting of the process cartridge, the projection 101 impinges on the receiving portion 104 of the standing upper transfer guide 103 earlier than the photosensitive drum 7, thereby pressing down the upper transfer guide 103. It is therefore rendered possible to prevent the photosensitive drum 7 from impinging on the guide 103 and to protect the photosensitive drum 7 from being damaged. In this operation, the projection 101 presses down the upper transfer guide 103 to return the same to the position prior to the generation of the sheet jamming. Therefore, the process cartridge B can be mounted and the image forming operation can be started immediately. The projection 101 is positioned outside the conveying area of the recording sheet in the longitudinal direction of the photosensitive drum 7. For this reason it does not hinder the conveyance of the recording sheet. Also in order that the mounting of the process cartridge B into the image forming apparatus is not hindered by the impingement of the projection 101 on the frame of the main body of the image forming apparatus, the groove 105 is provided in the frame for allowing entry of the projection 101 as shown in FIG. 5.

The shape of the frame of the present embodiment is secondly featured by a fact that the frame supporting the photosensitive drum 7 has an arc-shaped portion 102*c*. The arc-shaped portion 102*c* is provided in a position behind the photosensitive drum in the inserting direction of the process cartridge and outside the conveying area of the recording sheet in the longitudinal direction of the photosensitive drum 7. Also it is concentric with the photosensitive drum and has a larger radius than that of the photosensitive drum.

In the image forming apparatus A of the present embodiment, since the upper transfer guide 103 is rotatably mounted on the shaft 3*c*1 of the paired convey rollers 3*c* as explained in the foregoing, the upper transfer guide 103 may be lifted up by the jammed recording sheet 2 in case of sheet jamming under the upper transfer guide 103.

Figure 8:
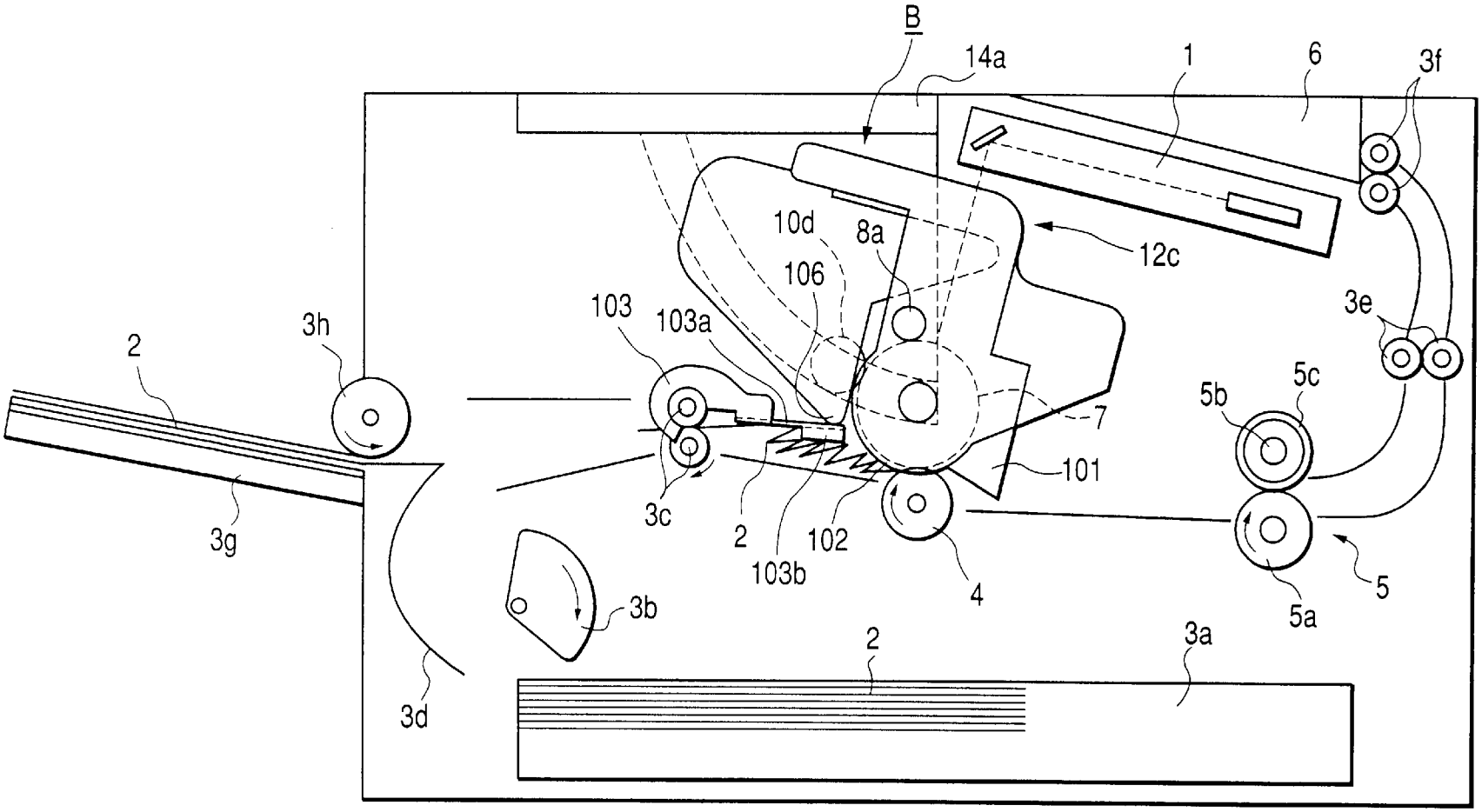
FIGS. 8 and 9 are lateral views showing the function of an arc-shaped portion provided in the frame of the process cartridge constituting an embodiment of the present invention.
Figure 9:
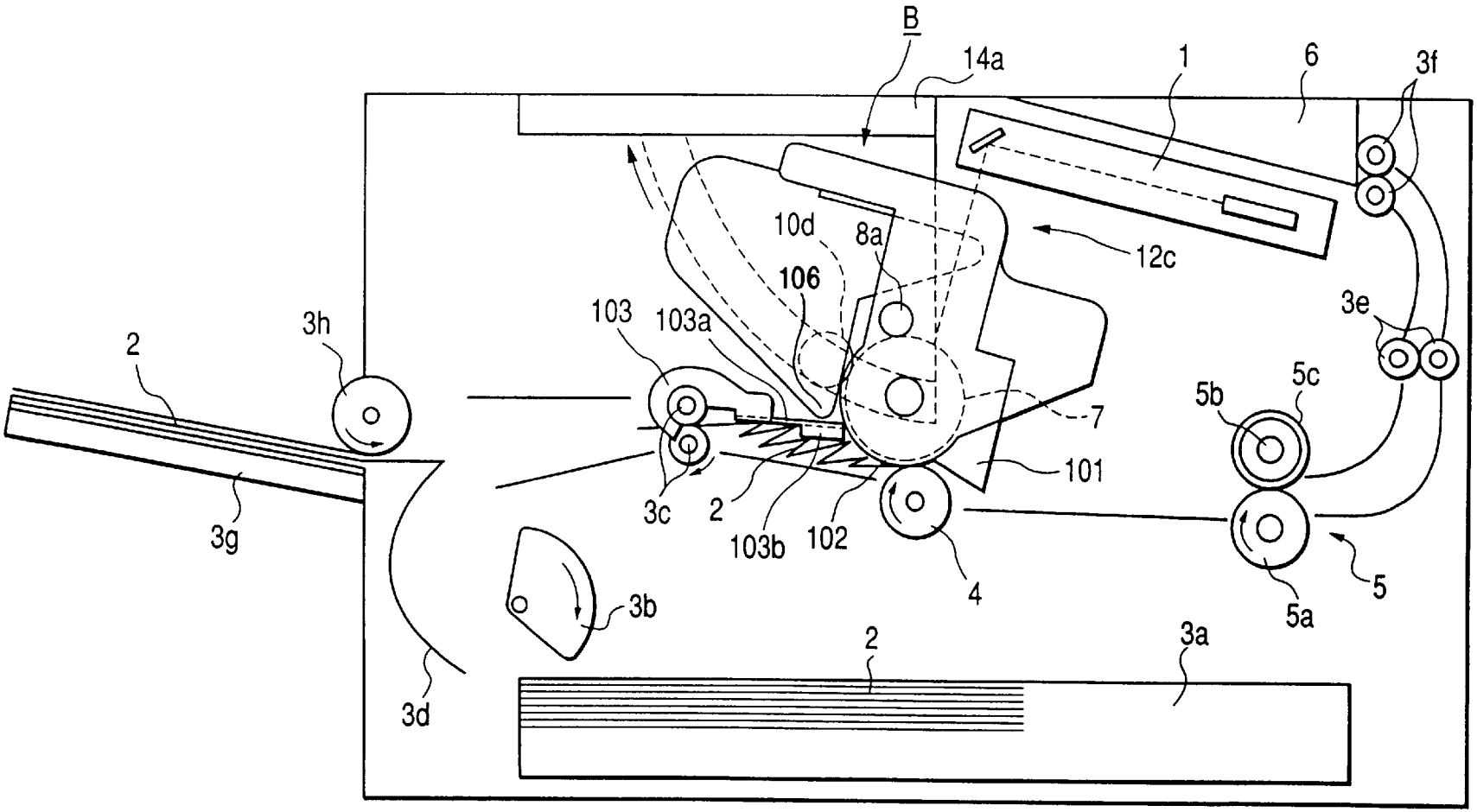

In such case, however, the upper transfer guide 103 can only be lifted to a position impinging on a corner 106 of the developing unit as shown in FIG. 8. Also the cleaning frame 12*c* supporting the photosensitive drum 7 is provided with the arc-shaped portion 102. Consequently when the operator detaches the process cartridge B, the arc-shaped portion 102 comes into contact with the receiving portion 104 so as to press down the upper transfer guide 103 as shown in FIG. 9. Therefore the detaching operation of the process cartridge B is not hindered. Furthermore, as the upper transfer guide 103 impinges on the arc-shaped portion 102 and is unable to come closer to the photosensitive drum 7, the photosensitive drum 7 is protected from being damaged by the upper transfer guide 103.

The arc-shaped portion 102 is not limited to being in an arc shape as long as it is so shaped as to press down the upper transfer guide 103 by impingement on the receiving portion 104 thereof and as to be outside the photosensitive drum 7 in the axial direction thereof.

Summing up the above embodiments, a process cartridge (B) is adapted for use in a main body of an electrophotographic image forming apparatus for forming an image on a recording medium (for example, recording sheet 2) which is provided with a guide member (for example, transfer upper guide 103) which is to guide the recording medium in the conveying direction thereof and which can assume either a guide position for guiding the recording medium in the conveying direction thereof or a retracted position retracted from the guide position. The cartridge comprises a cartridge frame (for example, cleaning frame 12*c*), an electrophotographic photosensitive member (7), process means (for example, charge means 8, develope means 10 and cleaning means) for acting on the electrophotographic photosensitive member, and a cartridge contact portion (for example, protrusion 102) to contact a main body contact portion (for example, receive portion 104) provided on the guide member if the guide member is in the retracted position in mounting the process cartridge in the main body of the apparatus to shift the guide member to the guide position, the cartridge contact portion being provided on the cartridge frame. Also, the cartridge contact portion (for example, protrusion 102) is provided at an end side in the axial direction of the drum-shaped electrophotographic photosensitive member, in such a manner as to protrude forward of the electrophotogrphic photosensitive member (7) in mounting the process cartridge (B) on the main body of the apparatus. The cartridge contact portion (for example, protrusion 102) is provided in such a manner as to protrude downwards from the electrophotographic photosensitive member (7) in mounting the process cartridge (B) in the main body of the apparatus.

The process cartridge further comprises a bevel gear (7*b*) for transmitting the driving force, received by the process cartridge (B) from the apparatus, to a developing roller, at the end side in the axial direction of the electrophotographic photosensitive member, wherein the developing rollers (10*b*) are provided for developing a latent image formed on the electrophotographic photosensitive member.

The cartridge contact portion (for example, protrusion 102) is provided outside the bevel gear in the axial direction of the electrophotographic photosensitive member (7), and is made of a plastic material and is integrally formed with the cartridge frame of a plastic material.

The cartridge contact portion protruding from the cartridge frame has a substantially triangular shape.

Here, the process cartridge comprises the charge means, developing means or cleaning means and the electrophotographic photosensitive member; at least one of the charge means, developing means and cleaning means and the electrophotographic photosensitive member; or at least the developing means and the electrophotographic photosensitive member. Such a cartridge is removably mounted on the main body of the image forming apparatus.

All of the above toner container 12*a*, developing frame 12*b*, cleaning frame 12*c*, protruded portion (protrusion) 101 and arc-shaped portion 102 are made of the plastic material, which may be polystylene, ABS resin (acrylonitrile/butadiene/stylene copolymer), polycarbonate, polyethylene or polypropylene.

The shape of above protrusion 102 is not limited to being triangular, but can have other shapes. Also, the protrusion 102 can be provided, other than the cleaning frame, on the cartridge frame which includes the cleaning frame, the developing frame and the toner container and forms the cartridge.

In the foregoing embodiments, the electrophotographic photosensitive member is not damaged nor is hindered in the removable from the main body of the image forming apparatus, even in case the process cartridge is detached while the guide member is pushed out of the conveying path by a sheet jam in the part of such guide member, or in case the process cartridge is mounted without returning the guide member to the original position after the jammed sheet disposal.

As explained in the foregoing, the present invention improves the mountability and operability of the process cartridge with respect to the main apparatus.

I claim:

1. A process cartridge detachably mountable to a main body of an electrophotographic image forming apparatus for forming an image on a recording medium, the electrophotographic image forming apparatus being provided with a guide member to guide the recording medium in a conveying direction thereof, the guide member being movable between a guide position for guiding the the recording medium in the conveying direction thereof and a retracted position retracted from the guide position, said process cartridge comprising:

a cartridge frame;

an electrophotographic photosensitive member;

a process member acting on said electrophotographic photosensitive member;

a first cartridge contact portion to impinge on a first guide contact portion provided on the guide member when the guide member is in the retracted position in mounting the process cartridge into the main body of said apparatus to move the guide member to the guide position, wherein said first cartridge contact portion is provided on said cartridge frame; and a second cartridge contact portion to abut against a second guide contact portion provided on the guide member so that the guide member is in the guide position when said process cartridge is mounted in the main body of said apparatus, wherein said second cartridge contact portion is located apart from said first cartridge contact portion.

2. A process cartridge according to claim 1, wherein said electrophotographic photosensitive member is in the shape of a drum, wherein said first cartridge contact portion is provided at an end side in an axial direction of said electrophotographic photosensitive member in such a manner as to protrude forward of said electrophotographic photosensitive member in mounting the process cartridge on the main body of said apparatus.

3. A process cartridge according to claim 2, wherein said first cartridge contact portion is provided in such a manner as to protrude downwards from said electrophotographic photosensitive member in mounting the process cartridge in the main body of said apparatus.

4. A process cartridge according to claim 1, 2 or 3, further comprising a gear for transmitting a driving force, received by the process cartridge from the apparatus, to a developing roller, at said end side in the axial direction of said electrophotographic photosensitive member, wherein said developing roller is provided for developing a latent image formed on said electrophotographic photosensitive member.

5. A process cartridge according to claim 4, wherein said first cartridge contact portion is provided outside said gear in the axial direction of said electrophotographic photosensitive member.

6. A process cartridge according to claim 5, wherein said first cartridge contact portion is made of a plastic material and is integrally formed with the cartridge frame made of a plastic material.

7. A process cartridge according to claim 4, wherein said first cartridge contact portion protruding from said cartridge frame has a substantially triangular shape.

8. A process cartridge according to claim 2 or 3, wherein said first cartridge contact portion is provided on a downstream side of said second cartridge contact portion in a mounting direction of said process cartridge into the main body of the electrophotographic image forming apparatus.

9. A process cartridge according to claim 8, wherein said first cartridge contact portion and said second cartridge contact portion are provided on side and the other side respectively in a direction intersecting a longitudinal direction of said electrophotographic photosensitive.

10. A process cartridge according to claim 1, wherein said process member includes at least one of charging member, developing member, and cleaning member.

11. A process cartridge according to claim 1, wherein said process cartridge makes at least a developing member as said process member and the electrophotographic photosensitive member one united cartridge to make them detachably mountable on the main body of the electrophotographic image forming apparatus.

12. A process cartridge according to claim 1, wherein said first cartridge contact portion is provided on a downstream side of said second cartridge contact portion in a mounting direction of said process cartridge into the main body of the electrophotographic image forming apparatus.

13. A process cartridge according to claim 12, wherein said electrophotographic photosensitive member is in the shape of a drum, wherein said first cartridge contact portion and said second cartridge contact portion are provided on one side and the other side respectively in a direction intersecting a longitudinal direction of said electrophotographic photosensitive.

14. A process cartridge according to claim 12, wherein said first cartridge contact portion is provided on a cleaning frame as said cartridge frame which supports a cleaning member as said process member, and said second cartridge contact portion is provided on a developing frame as said cartridge frame which supports a developing roller as said process member.

15. A process cartridge according to claim 1, wherein said second cartridge contact portion is provided on a developing frame as said cartridge frame which supports a developing roller as said process member.

16. A process cartridge according to claim 1, wherein said guide member guides the recording medium to a transfer position in which a toner image formed on said electrophotographic photosensitive member is transferred onto the recording medium.

17. A process cartridge according to claim 1, wherein a moving direction of the guide member from the retracted position to the guide position thereof is the same as a mounting direction of said process cartridge into the main body of the electrophotographic image forming apparatus.

18. An electrophotographic image forming apparatus which has a main body on which a process cartridge is detachably mountable, for forming an image on a recording medium, said electrophotographic image forming apparatus comprising:

a) a guide member which is to guide the recording medium in the conveying direction thereof and which is movable between a guide position for guiding the recording medium in the conveying direction thereof and a retracted position retracted from the guide position;

b) a mounting member for detachably mounting the process cartridge, said process cartridge including:

a cartridge frame;

an electrophotographic photosensitive member;

a process member for acting on said electrophotographic photosensitive member;

a first cartridge contact portion to impinge on a first guide contact portion provided on said guide member when said guide member is in said retracted position in mounting the process cartridge into the main body of said apparatus to move the guide member to the guide position, said first cartridge contact portion being provided on said cartridge frame; and a second cartridge contact portion to abut against a second guide contact portion provided on said guide member so that said guide member is in said guide position when said process cartridge is mounted in the main body of said apparatus, wherein said second cartridge contact portion is located apart from said first cartridge contact portion; and c) a conveying member for conveying the recording medium.

19. An electrophotographic image forming apparatus according to claim 18, wherein said guide member is manually movable between the guide position and the retracted position.

20. An electrophotographic image forming apparatus according to claim 18 or 19, wherein said guide member is adapted to guide the recording medium to a transfer position, in which a toner image formed on said electrophotographic photosensitive member is transferred onto the recording medium.

21. An electrophotographic image forming apparatus according to claim 20, wherein said first guide contact portion is provided in a position outside a conveying path of the recording medium.

22. An electrophotographic image forming apparatus according to claim 18, wherein said first guide contact portion is positioned in a mounting path of said process cartridge when said guide member is in said retracted position, whereby, in mounting the process cartridge into main body of the apparatus, the first cartridge contact portion provided on the process cartridge impinges on said first guide contact portion.

23. An electrophotographic image forming apparatus according to claim 18 or 22, wherein a moving direction of said guide member from the retracted position to the guide position thereof is the same as a mounting direction of said process cartridge into the main body of the apparatus.

* * * * *

UNITED STATES PATENT AND TRADEMARK OFFICE

CERTIFICATE OF CORRECTION

PATENT NO. : 6,009,288
DATED : December 28, 1999
INVENTOR(S) : Takashi Akutsu

It is certified that error appears in the above-identified patent and that said Letters Patent is hereby corrected as shown below:

Column 6,
Line 11, "develope" should read -- developing --.
Line 57, "polystylene," should read -- polystyrene, --.
Line 58, "butadiene/stylene" should read -- butadiene/styrene --.

Column 7,
Line 18, "the" (2nd occurrence) should be deleted.

Column 8,
Line 11, "on" should read -- on one --.
Lines 13 & 34, "photosensitive." should read -- photosensitive member. --.

Signed and Sealed this

First Day of January, 2002

*Attest:*

*Attesting Officer*

JAMES E. ROGAN
*Director of the United States Patent and Trademark Office*